US012250966B1

(12) United States Patent
Sliger

(10) Patent No.: US 12,250,966 B1
(45) Date of Patent: Mar. 18, 2025

(54) SMOKING PIPE ASSEMBLY

(71) Applicant: Bradley Joseph Sliger, Woodinville, WA (US)

(72) Inventor: Bradley Joseph Sliger, Woodinville, WA (US)

( * ) Notice: Subject to any disclaimer, the term of this patent is extended or adjusted under 35 U.S.C. 154(b) by 260 days.

(21) Appl. No.: 17/856,659

(22) Filed: Jul. 1, 2022

Related U.S. Application Data

(60) Provisional application No. 63/217,663, filed on Jul. 1, 2021.

(51) Int. Cl.
*A24F 1/28* (2006.01)

(52) U.S. Cl.
CPC ..... *A24F 1/28* (2013.01)

(58) Field of Classification Search
None
See application file for complete search history.

*Primary Examiner* — Phu H Nguyen
(74) *Attorney, Agent, or Firm* — Plager Schack LLP; Mark H. Plager, Esq.; Michael J. O'Brien, Esq.

(57) ABSTRACT

A smoking pipe assembly configured to provide pipe and lighter functionality to a user. The smoking pipe assembly has a sheath having generally a tubular shape with a bottom wall joined to a side wall having an open end. A bowl is formed on the sheath extending away from the side wall. An opening extends through the bowl and the side wall. A carburetor air opening is formed through the bottom wall. A plurality of interference fit ribs is joined to the side wall and the bottom wall. A lighter is inserted into the open end into the sheath and against the plurality of interference fit ribs. The sheath provides pipe functionality when separated from the lighter.

3 Claims, 4 Drawing Sheets

SMOKING PIPE ASSEMBLY

RELATED APPLICATION

This application claims priority to provisional patent application U.S. Ser. No. 63/217,663 filed on Jul. 1, 2021, the entire contents of which is herein incorporated by reference.

BACKGROUND

The embodiments herein relate generally to smoking accessories.

Prior to embodiments of the disclosed invention common portable smoking pipes required a separate lighter (or some object to create fire for ignition) to always be transported with the pipe to perform the full function of smoking out of a portable smoking pipe. Embodiments of the disclosed invention solve this problem.

SUMMARY

A smoking pipe assembly configured to provide pipe and lighter functionality to a user. The smoking pipe assembly has a sheath having generally a tubular shape with a bottom wall joined to a side wall having an open end. A bowl is formed on the sheath extending away from the side wall. An opening extends through the bowl and the side wall. A carburetor air opening is formed through the bottom wall. A plurality of interference fit ribs is joined to the side wall and the bottom wall. A lighter is inserted into the open end into the sheath and against the plurality of interference fit ribs. The sheath provides pipe functionality when separated from the lighter.

The side wall has a generally elliptical profile having a major axis and a minor axis. The plurality of interference fit ribs include two larger interference fit ribs and two smaller interference fit ribs.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
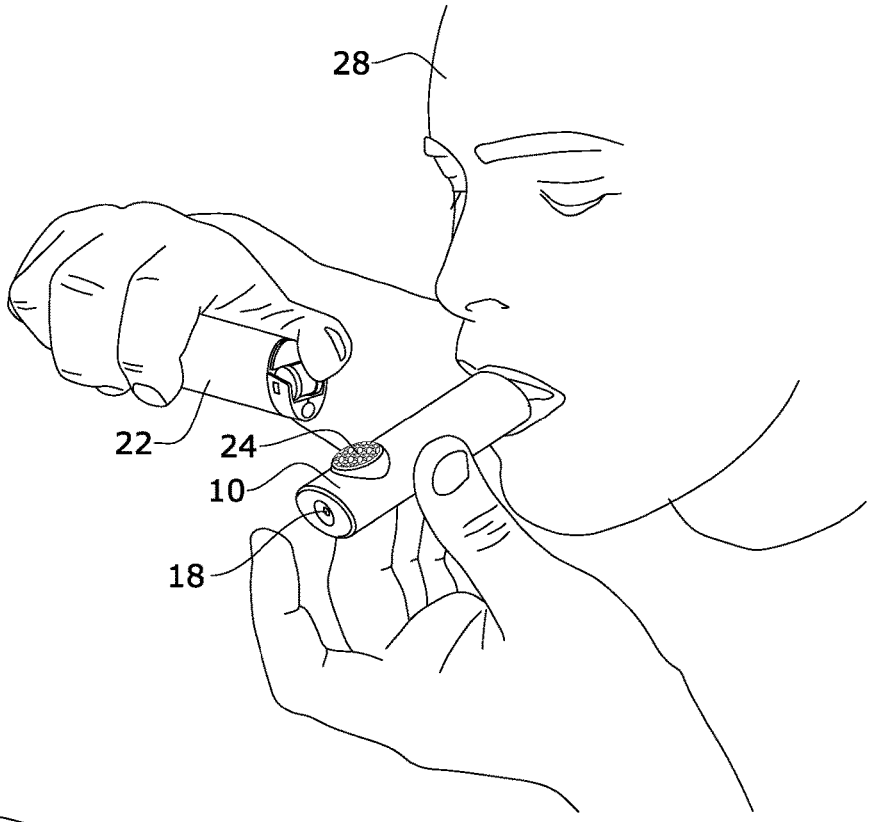
FIG. 1 shows a perspective view of one embodiment of the present invention shown in use in a first mode of operation.
Figure 2:
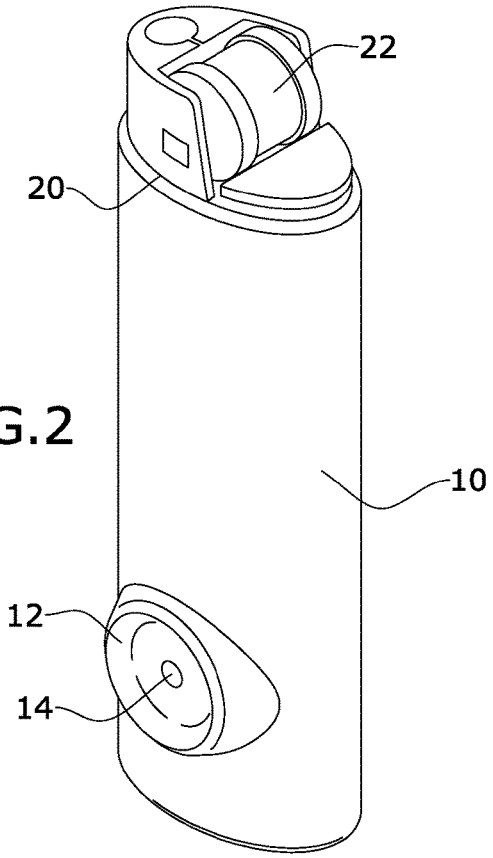
FIG. 2 shows a perspective view of one embodiment of the present invention shown in use in a second mode of operation.
Figure 3:
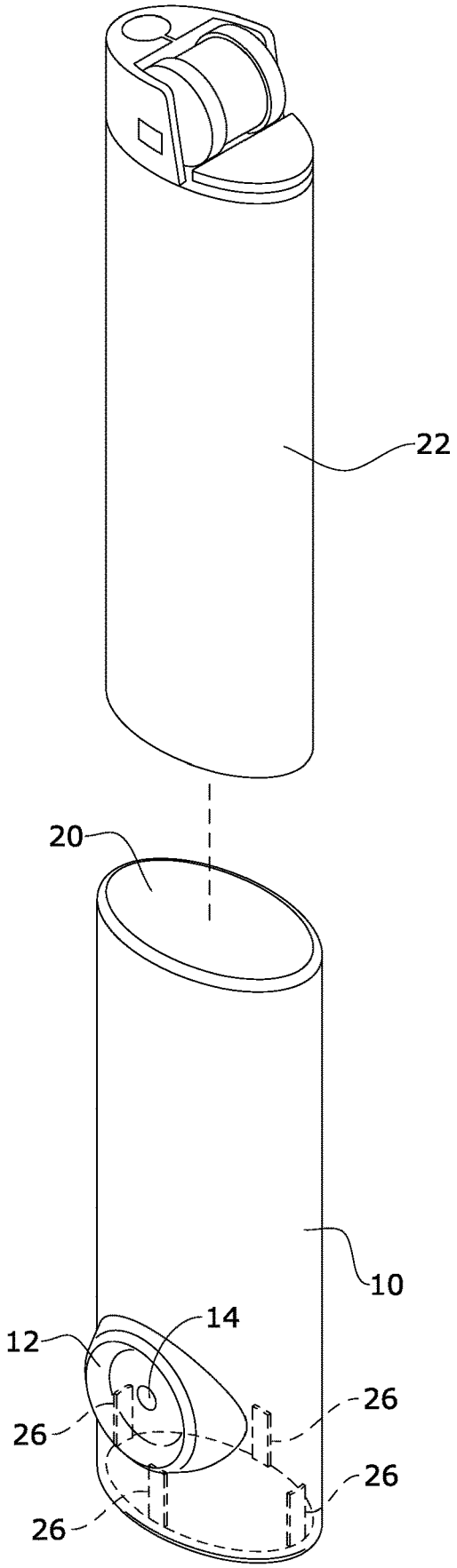
FIG. 3 shows an exploded view of one embodiment of the present invention.
Figure 4:
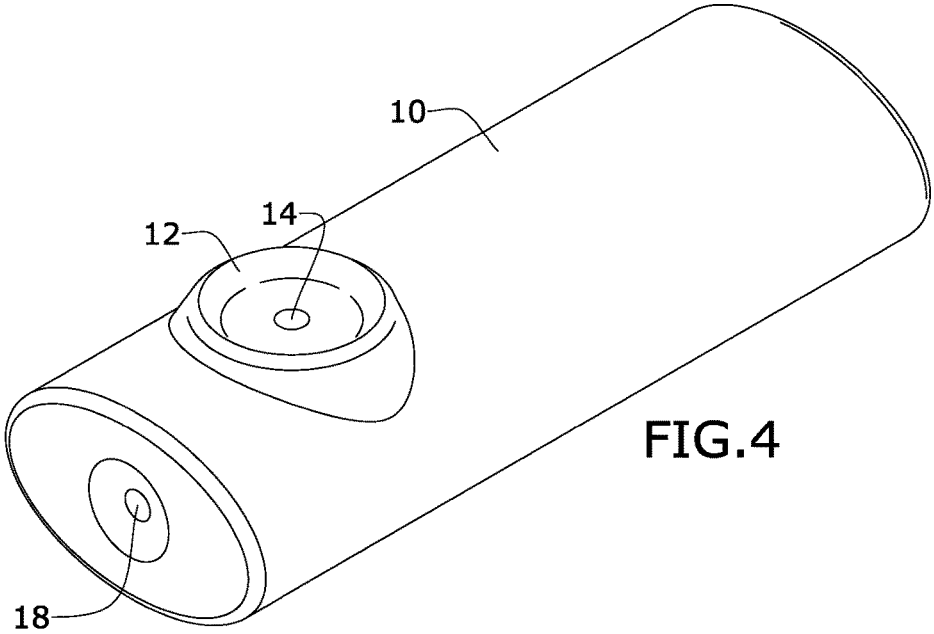
FIG. 4 shows a perspective view of one embodiment of the present invention.
Figure 5:
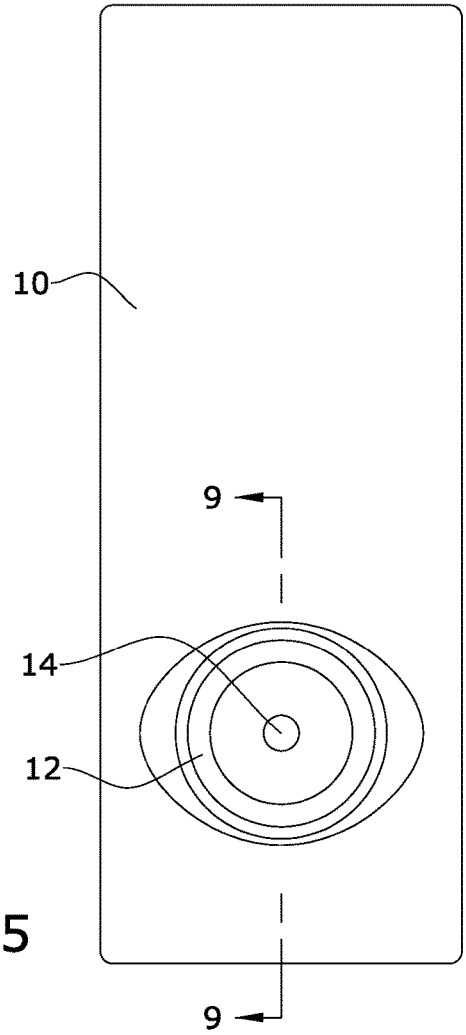
FIG. 5 shows a front view of one embodiment of the present invention.
Figure 6:
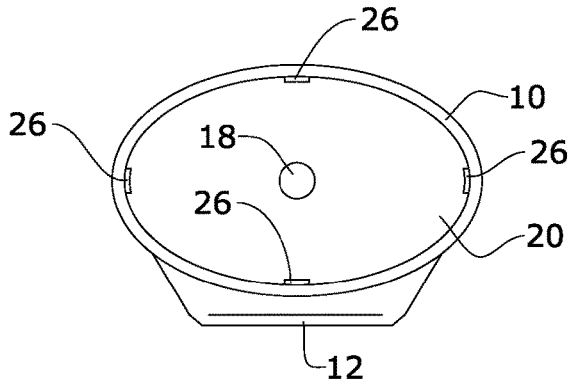
FIG. 6 shows a top view of one embodiment of the present invention.
Figure 7:
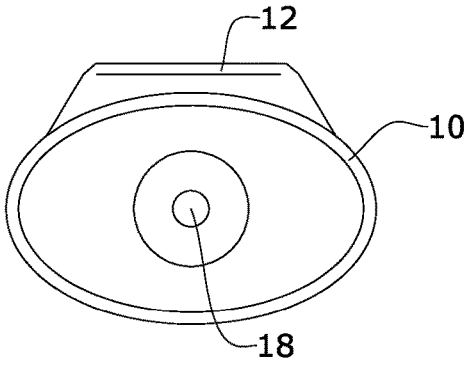
FIG. 7 shows a bottom view of one embodiment of the present invention.
Figure 8:
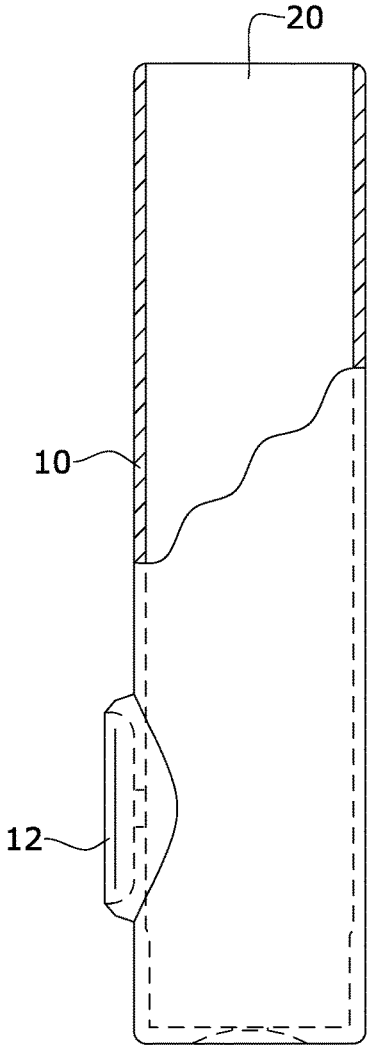
FIG. 8 shows a right-side view of one embodiment of the present invention.
Figure 9:
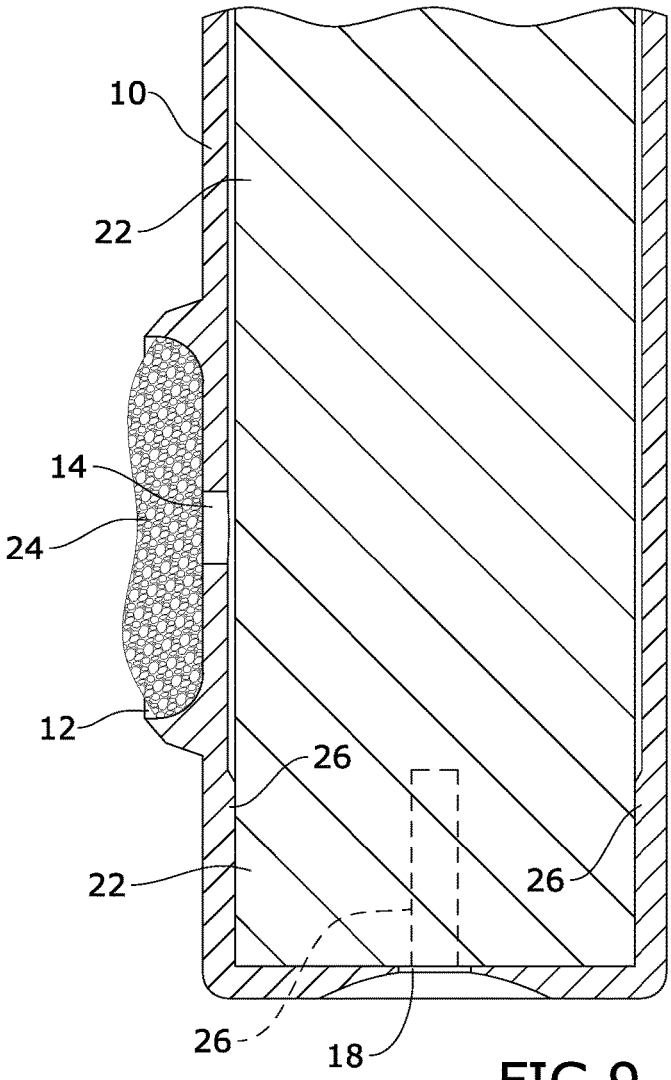
FIG. 9 shows a section view of one embodiment of the present invention taken along line 9-9 in FIG. 5.

By way of example, and referring to FIGS. 1-9, one embodiment of a smoking pipe assembly comprises a sheath 10. The sheath 10 is generally tubular with a bottom wall joined to a side wall having an open end 20. The side wall further comprises a bowl 12 extending away from the side wall and an opening 14 extending through the bowl and the side wall. The bottom side further comprises a carburetor air opening 18.

The side wall and the bottom wall further comprises a side wall inner side joined to a plurality of interference fit ribs 26. The side wall has a generally elliptical profile having a major axis and a minor axis. Accordingly, there are two larger interference fit ribs 26 and two smaller interference fit ribs 26.

A lighter 22, fits through the open end 20 and slides against the plurality of interference fit ribs 26. This creates an interference fit between the side wall ribs and the side edge of the lighter. The carburetor opening is critical, otherwise the lighter 22 creates a vacuum seal with the sheath 10 and cannot be removed easily.

Embodiments of the disclosed invention can be made with known materials using known processes. For instance, three-dimensional printing with either plastic or metal can be used. Additionally, metal injection molding (MIM) can be used to create units at a larger quantity.

MIM involves a material that starts as a stainless-steel powder and is mixed with a bonding agent that is injected into a two cavity mold with a slide. The slide is necessary to create the holes that go in different directions. The mold then ejects the part and is sintered to H900 to harden and remove the remainder of any bonding agent. The finish is applied by glass bead blasting.

As used in this application, the term "a" or "an" means "at least one" or "one or more."

As used in this application, the term "about" or "approximately" refers to a range of values within plus or minus 10% of the specified number.

As used in this application, the term "substantially" means that the actual value is within about 10% of the actual desired value, particularly within about 5% of the actual desired value and especially within about 1% of the actual desired value of any variable, element or limit set forth herein.

All references throughout this application, for example patent documents including issued or granted patents or equivalents, patent application publications, and non-patent literature documents or other source material, are hereby incorporated by reference herein in their entireties, as though individually incorporated by reference, to the extent each reference is at least partially not inconsistent with the disclosure in the present application (for example, a reference that is partially inconsistent is incorporated by reference except for the partially inconsistent portion of the reference).

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

Any element in a claim that does not explicitly state "means for" performing a specified function, or "step for" performing a specified function, is not to be interpreted as a "means" or "step" clause as specified in 35 U.S.C. § 112, ¶6. In particular, any use of "step of" in the claims is not intended to invoke the provision of 35 U.S.C. § 112, ¶6.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A smoking pipe assembly configured to provide pipe and lighter functionality to a user; the smoking pipe assembly comprising:

a sheath having generally a tubular shape with a bottom wall joined to a side wall having an open end;

a bowl, formed on the sheath extending away from the side wall;

an opening extending through the bowl and the side wall;

a carburetor air opening formed through the bottom wall;

a plurality of interference fit ribs, joined to the side wall and the bottom wall;

a lighter, inserted into the open end into the sheath and against the plurality of interference fit ribs;

wherein the sheath provides pipe functionality when separated from the lighter.

2. The smoking pipe assembly of claim 1, wherein the side wall has a generally elliptical profile having a major axis and a minor axis.

3. The smoking pipe assembly of claim 2, wherein the plurality of interference fit ribs include four interference fit ribs.

* * * * *